US009894967B2

(12) United States Patent
Sullivan

(10) Patent No.: US 9,894,967 B2
(45) Date of Patent: Feb. 20, 2018

(54) JEWELRY WITH EXOTIC NATURAL WOOD AND REAL FEATHERS

(71) Applicant: Kenneth P. Sullivan, Sterling, VA (US)

(72) Inventor: Kenneth P. Sullivan, Sterling, VA (US)

( * ) Notice: Subject to any disclaimer, the term of this patent is extended or adjusted under 35 U.S.C. 154(b) by 0 days.

(21) Appl. No.: 15/200,565

(22) Filed: Jul. 1, 2016

(65) Prior Publication Data

US 2018/0000209 A1 Jan. 4, 2018

(51) Int. Cl.

| | |
|---|---|
| ***A44C 25/00*** | (2006.01) |
| ***A44C 1/00*** | (2006.01) |
| ***A44C 5/00*** | (2006.01) |
| ***A44C 15/00*** | (2006.01) |
| ***A44C 9/00*** | (2006.01) |
| ***A44C 7/00*** | (2006.01) |
| ***A44C 23/00*** | (2006.01) |
| ***A45D 8/36*** | (2006.01) |
| ***A45D 8/02*** | (2006.01) |
| ***A45D 8/24*** | (2006.01) |
| ***A41G 9/00*** | (2006.01) |

(Continued)

(52) U.S. Cl.

CPC ..... *A44C 25/00* (2013.01); *A41G 9/00* (2013.01); *A44B 5/00* (2013.01); *A44B 9/00* (2013.01); *A44C 1/00* (2013.01); *A44C 5/00* (2013.01); *A44C 7/00* (2013.01); *A44C 9/00* (2013.01); *A44C 15/005* (2013.01); *A44C 15/0045* (2013.01); *A44C 23/00* (2013.01); *A44C 25/001* (2013.01); *A44C 25/002* (2013.01); *A45D 8/02* (2013.01); *A45D 8/24* (2013.01); *A45D 8/36* (2013.01); *A45D 2008/004* (2013.01)

(58) Field of Classification Search

CPC ..... A44C 25/00; A44C 25/001; A44C 25/002; A44C 1/00; A44B 5/00; A44B 9/00

See application file for complete search history.

(56) References Cited

U.S. PATENT DOCUMENTS 225,820 A 3/1880 Gilbert
279,351 A 6/1883 Daggett, Jr. et al.
(Continued)

OTHER PUBLICATIONS

Fernworks, Guinea Feather Pendant Necklace, Jul. 3, 2015, scoutmob.com, pp. 1-3.*
RubyandLuna, Feather Brooch, Dec. 11, 2012, etsy.com, pp. 1-6.*

*Primary Examiner* — Abigail E Troy
(74) *Attorney, Agent, or Firm* — Patent Analysis Research Tech. Systems LLC; George L. Walton

(57) ABSTRACT

An improved jewelry member comprises a transparent cover or shield member, a frame housing including a top surface, a bottom surface and a top peripheral wall portion bounded by an outer peripheral wall portion and an authentic or natural and polished wood member secured to the top surface of the frame housing. A shank fastening member secured to the bottom surface of the frame housing. At least one feather arrangement is disposed and fixed to the top surface of the authentic or natural polished wood member. The transparent cover or shield member is secured by a bonding material to at least the top surface of the authentic or natural polished wood member to completely cover the at least one feather arrangement and at least a portion of the authentic or natural and polished wood member and the frame housing to protect them from damage.

30 Claims, 8 Drawing Sheets

(51) Int. Cl.

| | |
|---|---|
| ***A44B 5/00*** | (2006.01) |
| ***A44B 9/00*** | (2006.01) |
| *A45D 8/00* | (2006.01) |

(56) References Cited

U.S. PATENT DOCUMENTS

| | | | |
|---|---|---|---|
| 1,410,075 | A | 3/1922 | Orstedt |
| 2,008,624 | A | 7/1935 | Mix |
| 2,052,437 | A | 8/1936 | Anderson et al. |
| 2,426,571 | A | 8/1947 | Wynne, Sr. et al. |
| 2,598,281 | A | 5/1952 | Meeker |
| 3,357,063 | A | 12/1967 | Eiben |
| 4,608,838 | A | 9/1986 | Gardner |
| 5,839,452 | A | 11/1998 | Sarwar |
| 8,590,341 | B2 | 11/2013 | Macmaster |
| 2012/0324710 | A1 | 12/2012 | Panopoulous |

* cited by examiner

JEWELRY WITH EXOTIC NATURAL WOOD AND REAL FEATHERS

CROSS REFERENCE TO RELATED APPLICATION(S)

None

BACKGROUND OF THE INVENTION

1. Field of the Invention

The present invention relates generally to a new and useful improvement in various pieces of jewelry and other ornaments. Such new and useful improvement of the various pieces of jewelry and other ornaments includes a smooth and polished exotic wood member having at least one surface for receiving authentic or natural feathers secured thereto. A transparent member or cover is disposed over the exotic and authentic or natural feathers and over at least portion of the smooth and polished exotic wood member for protection and smoothness.

2. Description of the Related Art

At the present time, there are many different types of jewelry pieces or ornaments that can be utilized with the present invention. These jewelry pieces or ornaments can be selected at least from the group consisting of cuff links, tie clips, tie pins, bolo ties, fastening studs, brooches, necklaces, bracelets, armlets, chokers, bangles, finger and ear rings, scarf pins, hair pins, hair hanglets, barrettes, hatpins, sarpech, breastplates, belly chains, findings, emblems, lockets, medallions, pendants, prayer jewelry, pledge pins, cameo, body piercing jewelry, costume jewelry, chatelaines, fascinators, head bands and membership pins to name just a few. Furthermore, it is well known in the jewelry art that other types of jewelry pieces or ornaments not listed above can be utilized, if desired. Note that none of these jewelry pieces or ornaments teaches the new and useful improvement of the present invention, alone or in combination with one another and/or with other features found in prior art patents.

In light of the present invention, the best prior art patents that were found do not teach jewelry pieces that have natural or artificial feathers disposed on a surface portion of the jewelry pieces in the same manner as described later and as shown in the drawings. Such jewelry pieces are identified as follows:

U.S. Pat. No. 225,820 A teaches a jewelry brooch piece or ornament that provides an upper cavity surface that receives natural feathers cemented to a piece of card board and further cemented therein. The jewelry brooch piece has an ornamental shield member attached to a base or frame member that covers and rest directly on the butt-ends of the feathers and clamping the same to the base or frame member.

U.S. Pat. No. 279,351 A teaches a jewelry breast pin piece of ornamental design with a back or body plate for receiving a face plate of different colors with various types of ornament designs thereon and secured just within a raised rim portion of the back or body plate.

U.S. Pat. No. 1,410,075 A teaches a jewelry holder device, such as, cufflinks, brooches, stick pins, hat pins, lockets, signet or clasp rings having an ornamental design that includes butterflies, wings or the like covered by a glass crystal.

U.S. Pat. No. 2,008,624 A teaches a tie bar or clasp with an upper portion that includes an ornamental sheath covering of any suitable material, such as, snakeskin, calfskin, pinseal, lizard, alligator or the like, or variegated fabric material.

U.S. Pat. No. 2,052,437 A teaches a cufflink jewelry piece with a top plate and shank assembly. The top plate includes an upper surface for receiving an ornamental design thereon, such as a miniature animal figure.

U.S. Pat. No. 2,426,571 A teaches a jewelry piece or ornament defining a costume jewelry pin of the type having an ornament consisting of appendages, such as feathers extending from a body portion of a wire and pin assembly with a keeper for receiving retaining a pin member after it has penetrated through clothing apparel. The wire and pin assembly includes a wire member with pair of bent ends defining finger hold members to easily slide the pin through clothing apparel and prevent grasping and damaging the feathers or any other utilized appendages. Further, the wire and pin assembly is shaped in the form of a fishing fly with one of the finger hold members bent to the general shape of a fishing hook.

U.S. Pat. No. 2,598,281 A teaches a cufflink with reversible front members consisting of different ornamental deigns and colors. The reversible front members are frictionally or otherwise held in selective reversible positions.

U.S. Pat. No. 3,357,063 A teaches a tie tack or pin assembly including an upper portion with a decorative or ornamental design disposed thereon.

U.S. Pat. No. 4,608,838 A teaches a cufflink with a base member that utilizes a varied range of face members both as to type and size without spinning or turning the face members. Further, the face members can utilize different types of stones, crystals and gems.

U.S. Pat. No. 5,839,452 A teaches a hair ornament of different ornamental designs. One of the ornamental designs that can be used is dried and artificial feathers (see column 6, lines 32-34).

U.S. Pat. No. 8,590,341 B2 teaches a multifunctional jewelry piece or ornament that can be utilized as a finger ring or hair piece. The top surface of the finger ring or hair piece can utilize different shape and size types of ornamental designs. Further, it is noted that one of the ornamental design types can use an ornamental arrangement of feathers (see column 4, lines 15-23).

Patent Publication No. 2012/0324710 A1 teaches a garment fastener that includes an ornament design comprising feathers.

DE 20110174 U1 teaches a brooch, ring or necklace that includes an ornamental design comprising feathers.

Note that none of the above mentioned prior patents teaches the unique present invention singly or any combination thereof, which will be discussed in greater detail in the "Summary of the Invention", recited below.

SUMMARY OF THE INVENTION

It is an object of the present invention to provide an improved jewelry piece or ornament with various types of exotic and authentic or natural wood members having a surface portion for receiving at least one exotic and authentic or natural feather arrangement secured or bonded thereto. The at least one exotic and authentic or natural feather arrangement can utilize a plurality of exotic and authentic or natural feathers of different types, arrangements, sizes, shapes and colors. Note that the least one exotic and authentic or natural feather arrangement can be secured to the surface portion of the various types of exotic and authentic or natural wood members by a bonding material selected from and not limited to the group consisting of resins, cements, epoxies, glues or any combinations thereof. The above recited surface portion of different types of exotic and authentic or natural wood members includes a top surface, a bottom surface and an outer peripheral wall defining a plurality of side wall surfaces.

It is another object of the present invention to provide a jewelry piece or ornament having a cavity portion in the top surface thereof for tightly receiving an exotic and authentic or natural wood member therein so that a top wall portion of the jewelry piece is near or in close proximity with the top surface of the exotic and authentic or natural wood member around its entire circumferential or perimeter area. The exotic and authentic or natural wood member can be secured by the above recited bonding material or by a releasable mechanical fastening means of various types, if desired.

It is also another object of the present invention to provide a jewelry piece or ornament with a continuous recessed groove of different sizes and shapes extending around an entire wall surface area thereof for receiving at least one exotic and authentic or natural feather therein. In addition, a recessed groove of different sizes and shapes can be disposed solely on at least a pair of side wall portions for receiving at least one exotic and authentic or natural feather arrangement therein.

It is a further object of the present invention to provide a cover or shield member solely over the entire top surface of the exotic and authentic or natural wood member to completely cover and protect the at least one exotic and authentic or natural feather arrangement from any damage or heavily pressing down on the at least one exotic and authentic or natural feather arrangement. Also, the cover or shield member can cover the entire top surface and the side wall portions of the exotic and authentic or natural wood member and the exotic and authentic or natural feather arrangement from any damage.

Optionally, the cover or shield member can be omitted from over the entire top surface and the side wall portions of the exotic and authentic or natural wood member so that the beauty and colors of the exotic and authentic or natural feather arrangements and the exotic and authentic or natural wood members are optimal visible to allow for a unique fashionable look.

This can be achieved by having the feather arrangements in the entire top surface and the side wall portions uncovered by the cover or shield member. This uncovering allows the feather arrangements to be disposed within holes, cavities, slots or channels of different shapes or configurations and sizes within the beautiful exotic and authentic or natural wood members of different sizes, and shapes or configurations in such a manner that the feather arrangements are protected and the beautiful colors of the feather arrangements and different wood-grains of the beautiful exotic and authentic or natural wood members are optimized and overcoming any light interference.

It is another object of the invention to have a reversible top surface member of a wear resistance hard material selected from and not limited to the group consisting of Formica, hard plastics, ceramics and other types of hard materials. The reversible top surface member includes an exotic and authentic or natural wood member spaced from the peripheral edges thereof.

The exotic and authentic or natural wood member is secured to the reversible top surface member by a bonding material. At least one exotic and authentic or natural feather arrangement is bonded to the exotic and authentic or natural wood member of the reversible top surface member and disposed within the plane of the exotic and authentic or natural wood member. This reversible top surface member includes a front wall edge that is bonded to an exotic and authentic or natural wood member handle member forming a single unit that engages a front L-shaped end of a jewelry piece or ornament when the reversible top surface member is fully inserted into the jewelry piece or ornament. A rear wall edge of the reversible top surface member abuts against an interior back wall of the jewelry piece or ornament when fully inserted therein.

Also, the jewelry piece or ornament has an interior cavity that receives the reversible top surface member. The interior cavity includes a pair of side walls with a channel disposed therein. A bottom surface of the jewelry piece has a pair of opposite end open slots that communicates with the pair of side wall channels. A preferred thin layer of hard material such as Formica is frictionally received within the pair of opposite bottom surface open end slots and ends within the pair of side wall channels to allow a pair of opposite side wall portions of the reversible top surface member to easily slide in and out of the interior cavity along the Formica within the pair of side wall channels to prevent any wear of the channel within the exotic and authentic or natural wood member.

Further, a bottom exposed rear end of the Formica includes a screw or tool opening for the insertion of a screw member or tool member therein for selectively removing the Formica from the open end slots and inserting the Formica into the open end slots. Note that various other types of mechanical inserting and removal means can be utilized, if desired.

It is also a further object of the invention to have a cover or shield member selected from and not limited to a transparent material group consisting of a resin sheet, glass, plastics, etc. to cover and protect various types of exotic and authentic or natural feather arrangements that are secured to the surface portion of various types of exotic and authentic or natural wood members. As previously mentioned, it is noted that the shield member can be omitted, if desired, so that the various types of exotic and authentic or natural feather arrangements and/or various types of exotic and authentic or natural wood members are openly exposed so that their beauty and colorization are truly captured and visible.

It is another object of the present invention to have a jewelry piece or ornament of different sizes and shapes that is selected at least from and not limited to the group consisting of cufflinks, tie clips, tie pins, bolo ties, fastening studs, brooches, necklaces, bracelets, armlets, chokers, bangles, finger and ear rings, scarf pins, hair pins, hair hanglets, barrettes, hatpins, sarpech, breastplates, belly chains, findings, emblems, lockets, medallions, pendants, prayer jewelry, pledge pins, cameo, body piercing jewelry, costume jewelry, chatelaines, fascinators, head bands, and membership pins.

It is also a further object of the present invention to have jewelry pieces or ornaments made from material selected from and not limited to the group consisting of wood, stainless steel, gold, brass, aluminum, silver and any combinations thereof. Note that other types of metals can be used, if desired.

It is yet a further object of the present invention to provide the exotic and authentic natural wood member with a smooth beautiful exterior surface grain with a polished, stained, glossy and semi-glossy finish or any combination thereof.

A further object according to the present invention provides the exotic and authentic or natural wood member and the at least one exotic and authentic or natural feather arrangement with at least one jewelry stone selected from and not limited to the group consisting of different sizes, shapes and types of precious and semi-precious stones, such as crystals, diamonds, emeralds, fossil coral, garnet, gems, jasper, jadeite, pearls, opal, quartz, sapphire, Tiger's eye, topaz, tourmaline to name just a few. Note that beautiful sea shells could be utilized rather than stones, if desired.

It is a further object according to the present invention to have the aforementioned preferred feather arrangement replaced or utilized in combination with other types of ornamental arrangements selected from and not limited to the group consisting of colorful sea shells, butterfly wings, leaves, flowers, fossils, antlers, horns, bones and teeth to name just a few.

Additional aspects, objectives, features and advantages of the present invention will become better understood with regard to the following description and the appended claims of the preferred embodiments with reference to the accompanying drawings.

BRIEF DESCRIPTION OF THE DRAWINGS

The present invention may be better understood, along with its numerous objects, features, and advantages made apparent to those skilled in the art by referencing the accompanying drawings.

DETAILED DESCRIPTION

Figures 1, 1A:
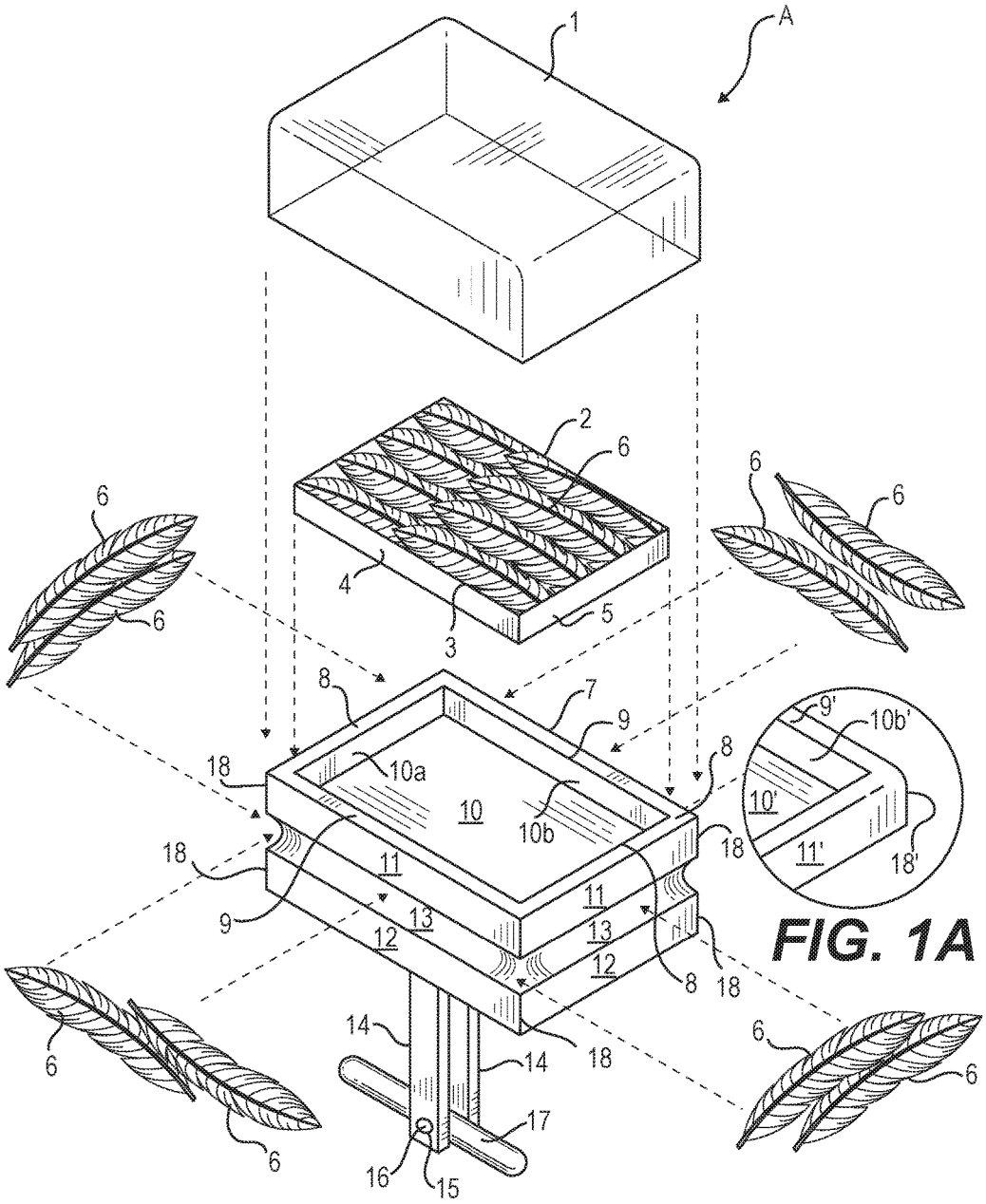
FIG. 1 illustrates an exploded perspective view of a jewelry piece or ornament defining a cufflink member including an exotic and authentic or natural wood member having a cavity and a continuous channel disposed there about and being filled with exotic and authentic or natural feathers with a protective cover or shield member according to the present invention.
FIG. 1A illustrates a cut-out section of the cufflink member of FIG. 1 that shows the four-sided interconnection between the front and rear outer wall ends 11' and outer side wall portions 12' are defined by substantial rounded edges 18' rather than having sharp edges 18 as illustrated in FIG. 1 of the present invention.

FIG. 1 illustrates an exploded perspective view of a jewelry piece or ornament defining a cufflink assembly represented by reference letter A. The cufflink assembly A includes a protective shield or cover member 1, a first exotic and authentic or natural finished wood member 2 with a top portion 3, a continuous outer peripheral wall defined by side walls 4 and front and rear side wall ends 5, at least one exotic and authentic or natural feather arrangement 6 attached to the top surface 3. Optionally, at least a jewelry stone may be secured to the top surface 3 at a selective location and being surrounded or embedded among the at least one exotic and authentic or natural feather arrangement 6, if desired.

Further illustrated in FIG. 1 is a second exotic and authentic or natural finished wood frame housing member 7 that includes a top portion forming a cavity member 10 having a bottom support floor surface bounded by a continuous top peripheral wall rim having top outer peripheral rear and front end wall rim portions 8 and top outer peripheral side wall portions 9, inner top peripheral rear and front end side wall portions 10*a* extending between the top outer peripheral rear and front end portions 8 and the bottom support floor surface of the cavity 10 and inner top peripheral side wall portions 10*b* extending between the top outer peripheral side wall portions 9 and the bottom support floor surface of the cavity 10.

Figure 2:
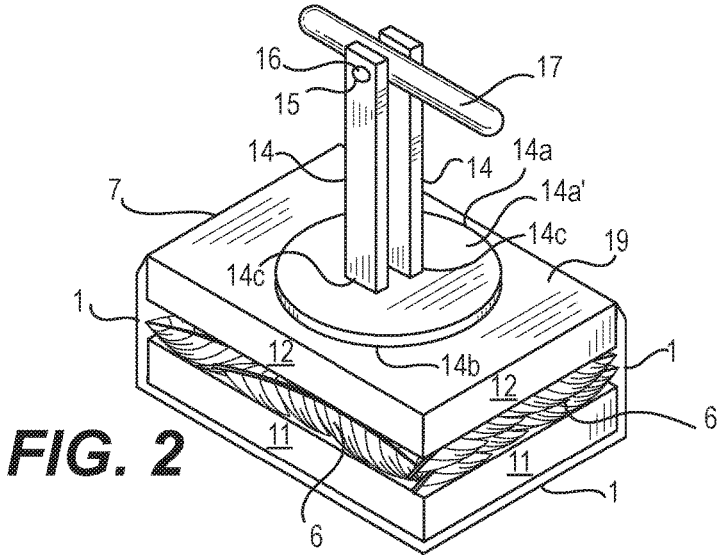
FIG. 2 illustrates a bottom perspective view of the jewelry piece or ornament defining a cufflink member including an exotic and authentic or natural wood member having a cavity and a continuous channel disposed there about and being filled with exotic and authentic or natural feathers with a protective cover or shield member according to the present invention.

Also, the second exotic and authentic or natural finished and polished wood frame housing member 7 further includes a continuous upper outer peripheral side wall defining front and rear outer wall ends 11 and outer side wall portions 11, a continuous lower outer peripheral side wall defining front and rear outer wall ends 12 and outer side wall portions 12, a continuous intermediate channel or groove 13 being formed between the upper front and rear outer wall ends 11 and outer side wall portions 11 and the lower front and rear outer wall ends 12 and outer side wall portions 12 for receiving at least one exotic and authentic or natural feather 6 therein and the cavity 10 having a bottom surface 19 (see FIG. 2). The top outer peripheral rear and front end wall rim portions 8, top outer peripheral side wall portions 9, the upper front and rear outer wall ends 11 and outer side wall portions 11 and the lower front and rear outer wall ends 12 and outer side wall portions 12 are interconnected at substantial sharp corner edges 18 to define a single unit.

The cufflink assembly A further includes a conventional cuff link shank fastening assembly defining a top plate support member 14*a* (shown in FIG. 2), a pair of longitudinally extending and spaced apart leg members 14, a toggle pin hole 15 at an aligned lower end of the a pair of longitudinal extending and spaced apart leg members 14, a toggle bar 17 that is received through a clothing hole or button hole for example, a shirt or blouse, and a toggle pin 16 that is disposed through each of the toggle pin holes 15 and an aligned toggle opening (not shown) in the toggle bar 17 for securing the toggle pin 16 between the pair of longitudinal extending and spaced apart leg members 14.

Note that the first and second exotic and authentic or natural wood members 2 and 7 are made from different types of beautifully finished, polished and smooth grained woods that includes surface coatings, natural finishes, pigmented finishes, penetrating finishes and waxing. These beautifully finished and smooth woods can be finished and selected from and not limited to the group consisting of different types of resins, glues, epoxies, varnishes, stains, dyes, lacquers, shellac, glazing and toning, pickling and liming, bleaching, distressing, enamels, polyurethane, natural oils and waxes, preservers, paints and any combinations thereof. Many of these finishes can be water-based or oil-based, and glossy or semi-glossy.

Also, it is to be understood that the exotic and authentic or natural wood members of FIGS. 3-18 are beautifully made from the different types of beautifully finished and smooth grained woods as indicated by the aforementioned selected group of finishes recited for the first and second exotic and authentic or natural wood members 2 and 7.

The at least one authentic or natural and exotic feather arrangement 6 may utilize a plurality of exotic and authentic or natural feathers 6 of different types, arrangements, sizes, shapes and colors. Note that the least one exotic and authentic or natural feather arrangement 6 or the plurality of exotic and authentic or natural and exotic feather arrangements 6 can be secured to the top surface portion 3 of various types of exotic and authentic or natural wood members 2 and the various types of exotic and authentic or natural wood members 2 are secured within the cavity 10 of various types of exotic and authentic or natural wood members 7 by a bonding material selected from and not limited to the group consisting of resins, cements, epoxies, glue or any combinations thereof.

The first exotic and authentic or natural wood member 2 is placed in the cavity 10 and bonded therein. Once inserted within cavity 10, the top portion 3 of the first exotic and authentic or natural wood member 2 is in close proximity to the top outer peripheral rear and front end wall rim portions 8 of the upper front and rear outer side wall ends 11 and the top outer peripheral side wall portions 9 of the upper outer side wall portions 11 of the defined continuous upper outer peripheral side wall of the second exotic and authentic or natural wood member 7, so that the at least one exotic and authentic or natural feather arrangement 6 is at or substantially flush with the top outer peripheral rear and front end portions 8 and the top outer peripheral side wall portions 9 of the second exotic and authentic or natural wood member 7.

This positioning of the first exotic and authentic or natural wood member 2 and the at least one exotic and authentic or natural feather arrangement 6 allows the shield or cover member 1 to be placed completely over the first and second exotic and authentic or natural wood members 2 and 7 without pressing down heavily on the plurality of exotic and authentic or natural and exotic feather arrangement 6 of the first and second exotic and authentic or natural wood members 2 and 7 without distorting them so that their ornamental beauty and colorization are clearly visible and protected from any damage.

The shield or cover member 1 may be a transparent material selected from and not limited to the group consisting of a resin sheet, glass and plastics to cover and protect the various types of exotic and authentic or natural feather arrangements 6. It is noted that the shield or cover member 1 may be omitted, if desired, so that the various types of exotic and authentic or natural feather arrangements 6 and/or the various types of exotic and authentic or natural wood members 2 and 7 are openly exposed so that their beauty and colorization are truly captured and clearly visible.

The cut-out section as shown in FIG. 1A shows that the four-sided interconnection between the upper front and rear outer wall ends 11' and outer side wall portions 11' of the aforementioned continuous upper outer peripheral side wall are defined by substantial rounded edges 18' rather than having sharp edges 18 as illustrated in FIG. 1. Note that the edges 18 and 18' can take on other shapes as well.

FIG. 2 shows a bottom view of the cufflink assembly A FIG. 1 that is assembled together as a single unit. This cufflink assembly A shows the cover or shield member 1 is disposed completely over and about the top surface 3 of the first exotic and authentic or natural wood member 2, the at least one exotic and authentic or natural feather arrangement 6 that is bonded to the top surface 3 and the plurality of exotic and authentic or natural feathers 6 secured or bonded within the intermediate continuous channel or groove 13 of the second exotic and authentic or natural wood member 7.

The cufflink assembly A of FIG. 2 shows the top plate support member 14*a* of the shank fastening assembly including a top surface (not shown), bottom surface 14*a'* and an outer circumferential wall portion 14*b* that is bonded to a bottom surface 19 of the second exotic and authentic or natural and wood member 7. Also, the pair of longitudinally extending and spaced apart leg members 14 having securing ends 14*c* secured to the bottom surface 14*a'* of the top plate support member 14*a* by any one of the aforementioned bonding materials or by various types of mechanical fastening means, if desired.

Further, the toggle pin hole 15 is disposed at an aligned lower end of the pair of longitudinal extending and spaced apart leg members 14, the toggle bar 17 is received through a clothing hole or button hole for example, a shirt or blouse. The toggle pin 16 is disposed through each of the toggle pin holes 15 and an aligned toggle opening (not shown) in the toggle bar 17 for securing the toggle pin 16 between the pair of longitudinal extending and spaced apart leg members 14 to enable the toggle bar 17 to be actuated or pivoted to a perpendicular cross position between the pair of longitudinally extending and spaced apart leg members 14. Also, the toggle bar 17 is actuated or pivoted to a parallel position that extends longitudinally between the pair of longitudinally extending and spaced apart leg members 14 when the toggle bar is to be removed from a clothing hole or button hole, for example, a shirt or blouse as recited above.

Figure 3:
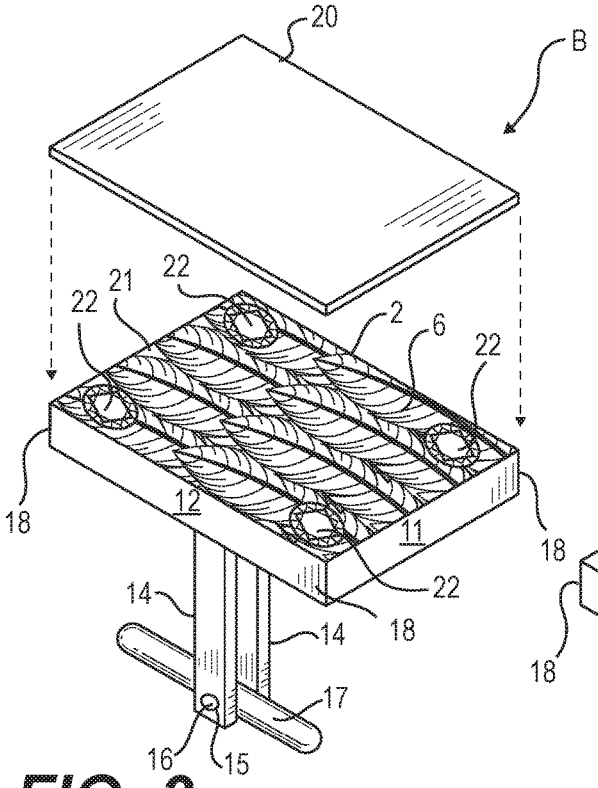
FIG. 3 illustrates an exploded perspective view of a jewelry piece or ornament defining a cufflink member including an exotic and authentic or natural wood member having a flat top surface with exotic and authentic or natural feathers and jewelry stones secured thereto and being covered with a protective cover or shield member according to the present invention.

FIG. 3 illustrates an exploded perspective view of a jewelry piece or ornament defining a cufflink member represented by reference letter B, which includes an exotic and authentic natural or wood member 2 (same as shown in FIG. 1) having a flat top surface 21 with at least one exotic and authentic or natural feather arrangement 6 or a plurality of exotic and authentic or natural feathers 6 with at least one jewelry stone 22 disposed thereon and being covered with a protective cover or shield member 20. The at least one exotic and authentic or natural feather arrangement 6 and the at least one jewelry stone or gem 22 are secured to the flat top surface 21 by any one of the aforementioned bonding materials. As shown in FIG. 3 a jewelry stone or gem 22 is placed at each corner of the top surface 21. Note that the jewelry stones or gems 22 can be designed in different arrangements and positioned at different specific locations on the flat top surface 21, if desired.

The exotic and authentic or natural and wood member 2 of FIG. 3 further includes front and rear ends 11 and side wall portions 12 with substantially sharp corner edges 18. The cufflink assembly B further includes a conventional cufflink shank fastening assembly defining a top plate support member 14*a* (shown in FIG. 4) with a top surface (not shown), an (not shown), an outer circumferential wall portion 14*b*, a pair of longitudinal extending and spaced apart leg members 14, a toggle pin hole 15 at an aligned lower end of the a pair of longitudinally extending and spaced apart leg members 14, a toggle bar 17 that is received through a clothing hole or button hole for example, a shirt or blouse, and a toggle pin 16 that is disposed through each of the toggle pin holes 15 and an aligned toggle opening (not shown) in the toggle bar 17 for securing the toggle pin 16 between the pair of longitudinally extending and spaced apart leg members 14.

Figure 4:
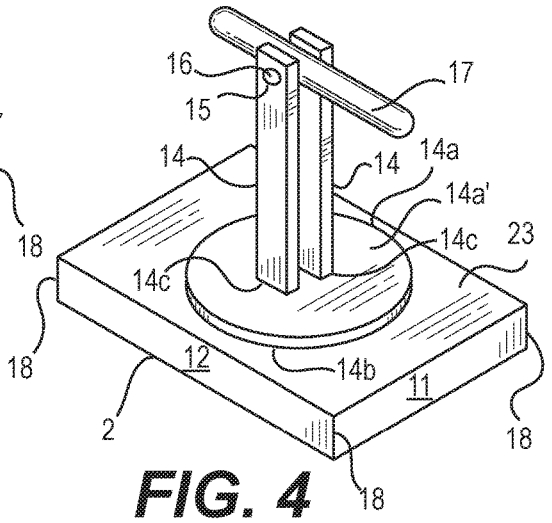
FIG. 4 illustrates a bottom perspective view of a jewelry piece or ornament defining a cufflink member including an exotic and authentic or natural wood member having a flat top surface with exotic and authentic or natural feathers and jewelry stones secured thereon and being covered with a protective cover or shield member according to FIG. 3 of the present invention.

FIG. 4 shows a bottom view of the cufflink assembly B of FIG. 3 that is assembled together as a single unit. The description of FIG. 4 has been recited in details above in FIG. 3 and will not be discussed any further in order to avoid redundancy.

The cufflink assembly B of FIG. 4 shows the top plate support member 14*a* with the upper surface (not shown) being bonded to a bottom surface 23 of the exotic and authentic or natural wood member 2 by one the aforementioned bonding materials. Also, the pair of longitudinally extending and spaced apart leg members 14 having securing ends 14*c* that is secured to a bottom or lower surface 14*a'* of the top plate support member 14*a* by any one of the aforementioned bonding materials or by various types mechanical fastening means, if desired.

In regards to FIGS. 1-4, the top plate support member 14*a* (shown in FIG. 4) with the top surface (not shown), the lower or bottom surface 14*a'*, the outer circumferential wall portion 14*b*, the pair of longitudinal extending and spaced apart leg members 14, the pair of longitudinal extending and spaced apart leg members 14 with the toggle pin hole 15 at the lower end thereof and the toggle bar 17 are made from a preferred material such as stainless steel. Note that other materials can be utilized, such as materials selected from and not limited to the group consisting of wood, gold, brass, aluminum, silver and any combinations thereof. Note that other types of metals and/or plastics can be used, if desired.

Figure 5:
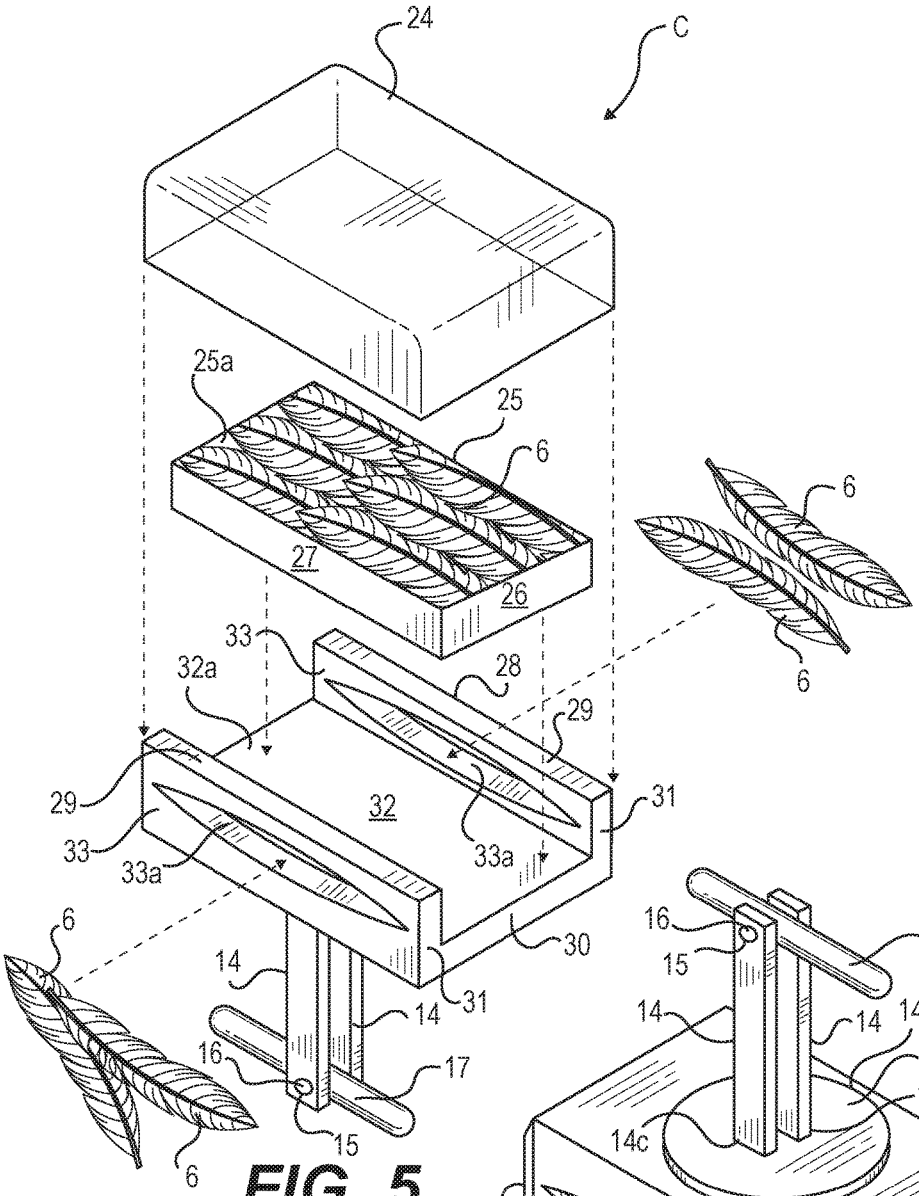
FIG. 5 illustrates an exploded perspective view of a jewelry piece or ornament defining a cufflink member including an exotic and authentic or natural wood member having an open-ended U-shaped cavity with a pair of side wall channels or slots disposed therein and being filled with exotic and authentic or natural feathers with a protective cover or shield member according to FIG. 5 of the present invention.

FIG. 5 illustrates an exploded perspective view of a jewelry piece or ornament represented by reference letter C. The jewelry piece or ornament C defines a cufflink assembly that includes a first exotic and authentic or natural wood frame housing member 28 having an open-ended U-shaped cavity 32 with a bottom floor 32*a*, upstanding inner and outer side walls 33 connected to the bottom floor 32*a* and a pair of side wall channels or slots 33*a* disposed in the upstanding inner and outer side walls 33 and each being filled with at least one exotic and authentic or natural feather arrangement 6 and bonded therein by one of the aforementioned bonding materials. Also, the open-ended U-shaped cavity 32 includes front and rear end faces or wall portions 30 of the open-ended U-shaped cavity 32 with upstanding wall leg portions 31 extending perpendicularly there from. The upstanding wall leg portions 31 extend up to corner edges that interconnect with top rim wall portions 29 of the inner and outer side walls 33 defining a continuous peripheral outer wall.

The first exotic and authentic or natural wood frame housing member 28 further includes a second exotic and authentic or natural wood member that has a top flat surface 25*a* that receives at least one feather arrangement 6 that is secured thereto by one of the previous recited bonding materials. Also, the second exotic and authentic or natural wood member 25 includes front and rear ends 26 and a pair of side walls 27. In addition, the second exotic and authentic or natural wood member 25 is disposed within the open-ended U-shaped cavity 32 and secured therein by one of the aforementioned bonding materials.

Note that the second exotic and authentic natural wood member 25 is disposed at a height that is positioned in proximity to the top rim wall portions 29 when it is fully fixed within the open-ended U-shaped cavity 32, so that the at least one feather arrangement 6 is at least even with the top rim wall portions 29 and the at least one feather arrangement 6 that is disposed within the channels or slots 33*a* of the first exotic and authentic or natural wood frame housing member 28 so that the protective cover or shield member 24 do not heavily compress or distort the at least one feather arrangement 6 disposed on the top flat surface 25*a* of the second exotic and authentic or natural wood frame housing member 28 and the at least one feather arrangement 6 that is disposed within the channels or slots 33*a* of the first exotic and authentic or natural wood frame housing member 28. This allows the above at least one feather arrangements 6 to be non-distorted so that its ornamental beauty and colorization is always maintained when the protective cover or shield member 24 covers the entire first exotic and authentic or natural wood frame housing member 28 and the second exotic and authentic or natural wood member 25.

Figure 6:
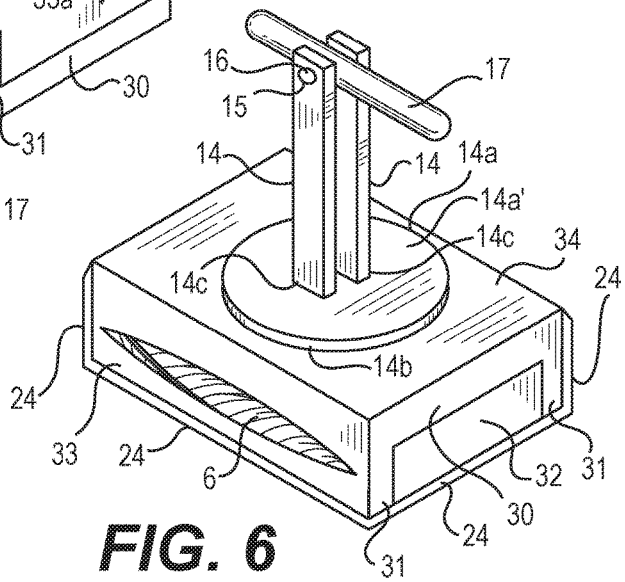
FIG. 6 illustrates a bottom perspective view of a jewelry piece or ornament defining a cufflink member including an exotic and authentic or natural wood member having an open-ended U-shaped cavity with a pair of side wall channels or slots disposed therein and being filled with exotic and authentic or natural feathers with a protective cover or shield member according to the present invention.

FIG. 6 depicts a bottom view of the cufflink assembly C as shown in FIG. 5, which is shown as being assembled together as a single unit. Cufflink assembly C shows the cover or shield member 24 disposed completely over and about the top surface 25*a* and the at least one feather arrangement 6 of the second exotic and authentic or natural wood member 2 and the first exotic and authentic or natural wood frame housing member 28 and the exotic and authentic or natural feather arrangement 6 disposed and fixed within the channels or slots 33*a* of side walls 33 of the first exotic and authentic or natural wood frame housing member 28. Optionally, the exotic and authentic or natural feather arrangement 6 within the channels or slots 33*a* of side walls 33 of the first exotic and authentic or natural wood frame housing member 28 can be tightly inserted therein without being bonded therein.

The cufflink assembly C of FIG. 6 shows a conventional shank fastening assembly including a top plate support member 14*a* that is bonded to a bottom surface 34 of the first exotic and authentic or natural wood member 28, which has the pair of longitudinal extending and spaced apart leg members 14 with securing ends 14*c* secured to a lower or bottom surface 14*a*' of the top plate support member 14*a* by any one of the aforementioned bonding materials or by various types of mechanical fastening means, if desired.

Referring to FIGS. 5-6, the top plate support member 14*a* (as shown in FIG. 6) having an upper surface (not shown), the lower surface 14*a*', an outer circumferential wall portion 14*b*, a pair of longitudinal extending and spaced apart leg members 14 with a toggle pin hole 15 at an aligned lower end thereof and a toggle bar 17 that are made from a preferred material such as stainless steel. Optionally, other materials can be utilized, such as materials selected from the group consisting of wood, gold, brass, aluminum, silver and any combinations thereof. Note that other types of metals and/or plastics can be used, if desired.

Figure 7:
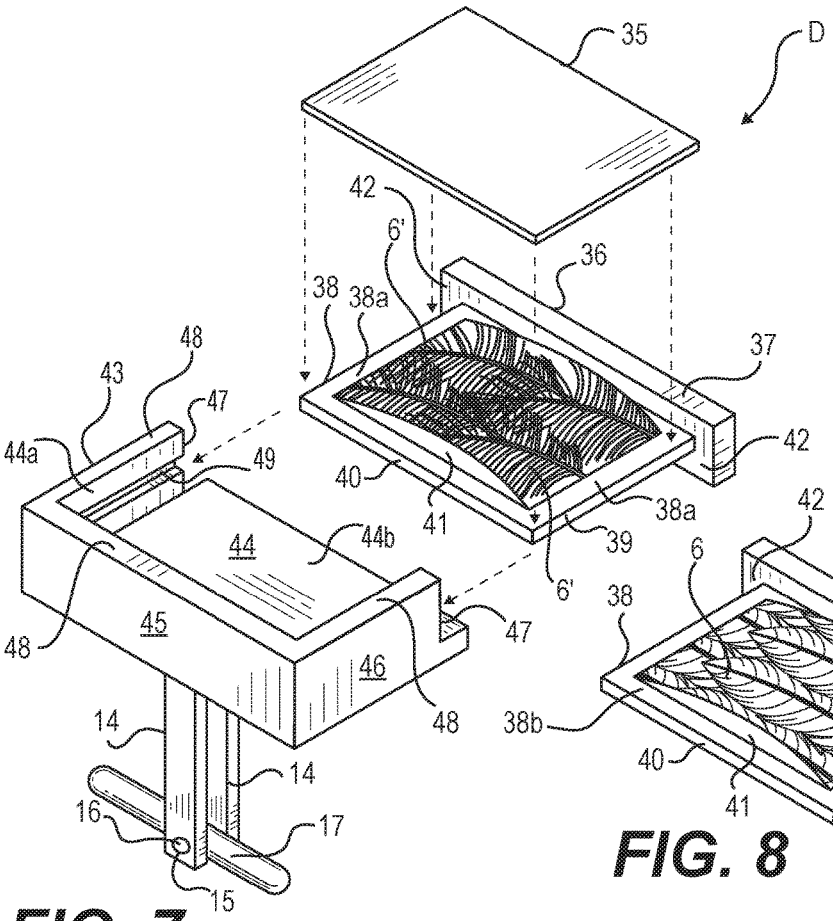
FIG. 7 illustrates an exploded perspective view of a reversible cufflink member including an exotic and authentic or natural wood member having an open front end that receives a reversible sliding member of a hardened material that includes an exotic and natural wood member with exotic and authentic or natural feathers secured thereto that slide along a groove in an interior side wall of the exotic and authentic or natural wood member for closing the front open end of the exotic and authentic or natural wood member and having a protective cover or shield member according to the present invention.

Reference letter D illustrates an exploded perspective view of a reversible jewelry piece or ornament defining a cufflink assembly as shown in FIG. 7. This reversible cufflink assembly D includes a second exotic and authentic or natural polished wood frame member defining a housing member 43 having inner and outer rear or back walls 45, a pair of outer side walls 46, a pair of interior side walls 44*a* and a bottom floor surface 44*b* defining a cavity 44 with an open front end forming an outer bordering side wall. The open front end of the cavity 44 includes a pair of upstanding engaging face members 47 of the pair of outer side walls 46 and the pair of interior side walls 44*a* that interconnects with a front end portion of the bottom floor surface 44*b* defining an L-shape. Also, the inner and outer rear or back walls 45, the pair of outer side walls 46 and the pair of interior side walls 44*a* includes a top bordering rim surface 48.

Each of the interior side walls 44*a* further includes a slot member 49 within the pair of interior side walls 44*a* for receiving an insert 49*a* (shown in FIG. 9A) that is made from a hard-like material that prevents wear and damage to the second exotic and authentic or natural wood frame housing member 43. Note that the insert 49*a* will be discussed in greater details below.

Also, the reversible cufflink assembly D further includes a reversible slidable tray-like member 38 made from a hard-like material that includes a top surface area 38*a*, a pair of outer side wall portions 39 and front and rear end wall portions 40. The top surface area 38*a* has a first exotic and authentic or natural wood member 41 that is bonded to the top surface area 38*a* and extends substantially over a major portion of the top surface area 38*a*. Note that the outer peripheral ends of the first exotic and authentic or natural wood member 41 is spaced from the edges of the pair of outer side wall portions 39 and front and rear end wall portions 40 to eliminate any damage to the first exotic and authentic or natural wood member 41 when it is slidably inserted into the cavity 44 via the open front end thereof and along each of the slot members 49 within the pair of interior side walls 44*a*.

Additionally, the reversible slidable tray-like member 38 includes a handle member 36 having a top end surface 37 and a front end face surface 36*a* (see FIG. 9) and a rear end face surface 42 that abuts against the pair of L-shape upstanding engaging face members 47 of the pair of outer side walls 46 and the pair of interior side walls 44*a* that interconnects with a front end portion of the bottom floor surface 44*b* when fully inserted within cavity 44. When the reversible slidable tray-like member 38 is fully inserted within the cavity 44 the handle member 36 defines a complete outer peripheral wall with the inner and outer rear or back walls 45, the pair of outer side walls 46, the pair of interior side walls 44*a* and the bottom floor surface 44*b* for completely enclosing the cavity 44.

Note that the rear end face 42 is secured to the front end wall portion 40 defining a unitary reversible slidable tray-like member 38, preferably with a bonding type material as previously mentioned. At least one ornamental and authentic or natural feather arrangement 6 is fixed to a top surface area of the first exotic and authentic or natural wood member 41 by one of the aforementioned bonding materials. It is to be noted that other types of bonding materials and mechanical securing means can be utilized, if desired.

Optionally, the aforementioned reversible slidable tray-like member 38 that is made from a hard-like material could be made of a third exotic and authentic or natural wood tray-like member that would include the same reference numerals as the hard-like material of the slidable tray-like member 38 as recited above, if desired, and is represented as the first exotic and authentic or natural and polished wood member 38.

Furthermore, it is apparent that the first exotic and authentic or natural and polished wood member 41 can be eliminated and the exotic and authentic or natural feather arrangement 6 is fixed directly to the top surface 38*a* of the third exotic and authentic or natural and polished wood tray-like member. The pair of outer side wall portions 39 and front and rear end wall portions 40 of the third exotic and authentic or natural and polished wood tray-like member 38 are coated with the hard-like material to eliminate any damage to the second exotic and authentic or natural and polished wood member 43 and the third authentic or natural and polished wood tray-like member 38 when it is slidably inserted into the cavity 44 of the open front end along the slot member 49 within the pair of interior side walls 44*a* of the second exotic and authentic or natural and polished wood member 43.

Preferably, the hard-like material can be selected from the group consisting of Formica. Obviously, other types of hard-like materials can be utilized to prevent any damage and wear to the second exotic and authentic or natural and polished wood member 43 and the reversible slidable tray-like member 38 when it slides along the along the slot member 49 within the pair of interior side walls 44*a* of the second exotic and authentic or natural and polished wood member 43. It is noted that the slot member 49 includes a hard-like material 49*a* that will be discussed in greater details below in FIG. 9A.

Figure 8:
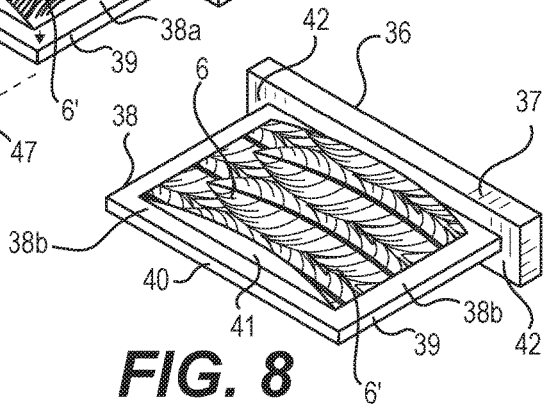
FIG. 8 illustrates a top perspective view of another reversible side of the reversible sliding member of a hardened material that includes an exotic and authentic or natural wood member with exotic and authentic or natural feathers secured thereto and having a handle member at front end thereof according to FIG. 7 of the present invention.

In order to omit redundancy, FIG. 8 shows the reverse side of the tray-like member 38 with the same reference numbers as shown in FIG. 7. The only difference is a different design type of a colorful exotic and authentic or natural feather arrangement 6 affixed to a top surface of another or separate exotic and authentic or natural wood member 41 that is secured to a bottom surface 38*b* of the reversible tray-like member 38 by the aforementioned bonding materials.

Now referring to FIGS. 7-9A, a user easily grasps and actuates the handle 36 and slides the tray-like member 38 along each of the slot members 49 in the inner side walls 44*a* and reverses the colorful exotic and authentic or natural feather arrangements 6 and 6' to a desired fashionable look that the user wants to accomplish. The insertion of the tray-like member 38 along each of the slot members 49 in the inner side walls 44*a* will achieve a tight sliding engagement that will maintain the tray-like member 38 in each of the slot members 49 in the inner side walls 44*a*.

Figure 9A:
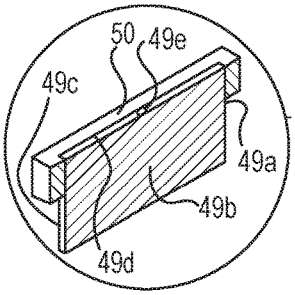
FIG. 9A illustrates a cut-sectional view of a hardened material that is inserted through the spaced apart slots and into the groove of the interior side walls of the exotic and authentic or natural wood member according to FIG. 7 and FIG. 9 of the present invention.
Figure 9:
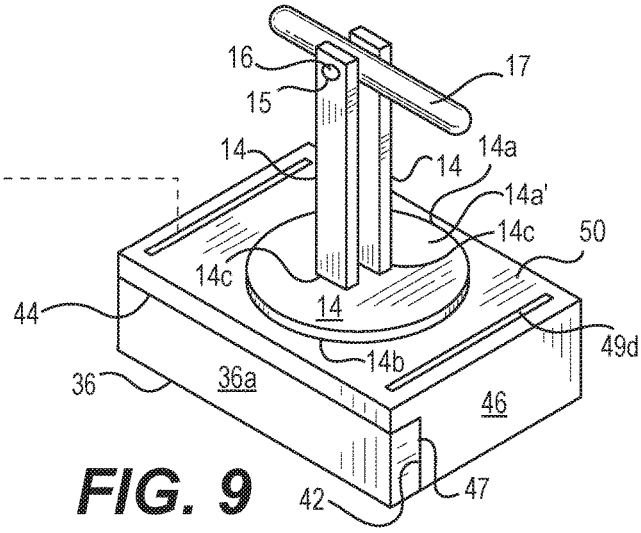
FIG. 9 illustrates a bottom perspective view of the reversible cufflink member with spaced apart slots for receiving the hardened material that extends into and becomes an integral part of the groove in the interior side walls of the exotic and authentic or natural wood member according to FIG. 7 of the present invention.

FIG. 9 shows a bottom view of the cufflink assembly D as shown in FIG. 7, which is shown as being assembled together as a single unit. The cufflink assembly D shows the reversible tray-like member with the handle member 36 in a closed slidable position. The handle 36 depicts a front face surface 36*a* and an inner face surface 42 that engages with the pair of upstanding engaging face members 47 that interconnects with the front end portion of the bottom floor surface 44, which defines the aforementioned L-shape.

The cufflink assembly D of FIG. 9 illustrates a top plate support member 14*a* that is attached to an upper end of a pair of longitudinal extending and spaced apart leg members 14 and is secured to a bottom surface 50 of the by any one of the aforementioned bonding materials or by various types of mechanical fastening means, if desired.

Referring to FIGS. 7 and 9, the top plate support member 14*a* (shown in FIG. 9) with an outer circumferential wall portion 14*b*, the pair of longitudinal extending and spaced apart leg members 14, the pair of longitudinal extending and spaced apart leg members 14 having a toggle pin hole 15 at an aligned lower end thereof and a toggle bar 17 are made from a preferred material such as stainless steel. Note that other materials can be utilized, such as materials selected from the group consisting of wood, gold, brass, aluminum, silver and any combination thereof. Note that other types of metals and/or plastics can be used, if desired.

In addition, the bottom surface 50 includes a pair of spaced apart slots 49*d* at opposite ends thereof. These slots 49*d* receive the above mentioned hard-like material 49*a*, such as Formica that is inserted therein and into the slot members 49 of the inner side walls 44*a* to eliminate any damage and wear to the second exotic and authentic or natural and polished wood member 43. Details of the spaced apart slots 49*d* and the hard-like material 49*a* are shown in a cut-out view illustrated in FIG. 9A. In FIG. 9A, the hard-like material 49*a* has a pair of opposite side face surfaces 49*b* and opposite edge surfaces 49*c* that slides within the interior of the spaced apart slots 49*d* as shown in the bottom surface 50 in a tight engaging manner. Further, the hard-like material 49*a* includes a tool opening 49*e* for easy insertion and removal of the hard-like material 49*a* in and out of the spaced apart slots 49*d* in the bottom surface 50.

Note that the tool opening 49*e* can use special tool members, screw means, pliers, wrenches and other types of tools for easy removal of the hard-like material 49*a* from the spaced apart slots 49*d*. Optionally, the hard-like material 49*a* could be permanently fixed within the spaced apart slots 49*d*, if desired.

Figure 10:
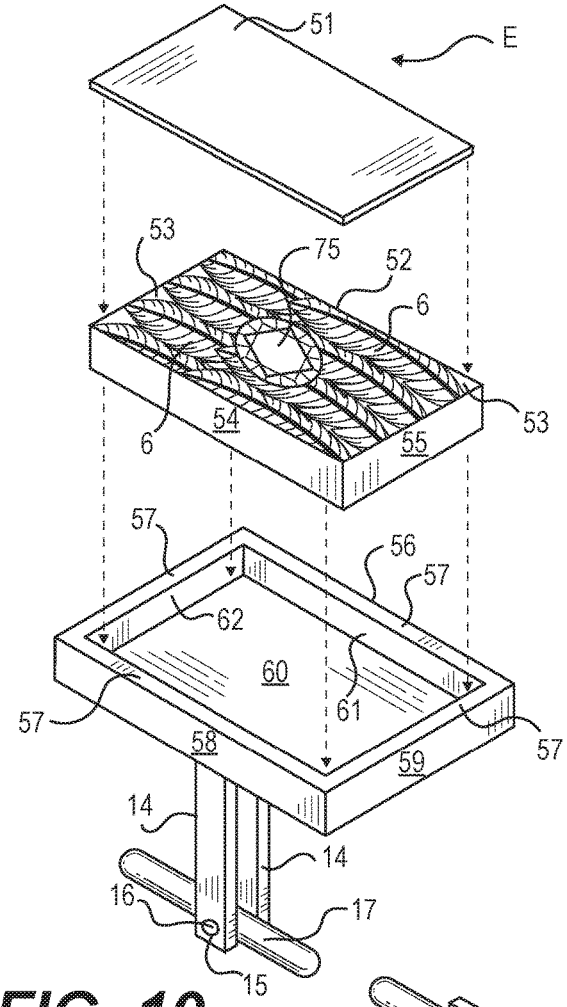
FIG. 10 illustrates an exploded top perspective view of a jewelry piece or ornament defining a stainless steel cuff link member having a cavity for receiving an exotic and authentic or natural wood member with exotic and authentic or natural feathers and at least a jewelry stone secured thereon and being covered with a protective shield member according to the present invention.

Reference letter E of FIG. 10 illustrates another jewelry piece or ornament defining a stainless steel cufflink assembly. This cufflink assembly E includes a cover or shield member 51, an exotic and authentic or natural and polished wood member 52 with a top surface 53, a pair of side walls 54 and front and rear end walls 55, an exotic and authentic or natural feather arrangement 6 affixed to the top surface 53 and a jewelry stone or gem 75 is disposed in a central location of the top surface 53 and being surrounded by the exotic and authentic or natural feather arrangement 6 to create a unique fashionable and colorable design. Also, the jewelry stone or gem 75 is bonded to the top surface 53 by the previously recited bonding materials.

FIG. 10, further includes a stainless steel frame housing 56 with a shallow cavity 60 that is bounded by front and rear outer wall end portions 59, front and rear inner wall end portions 62, outer side wall portions 58 and an inner side wall portions 61. A peripheral top wall rim portion 57 that extends around the entire circumference of the front and rear outer wall end portions 59, the front and rear inner wall end portions 62, the outer side wall portions 58 and the inner side wall portions 61.

Figure 11:
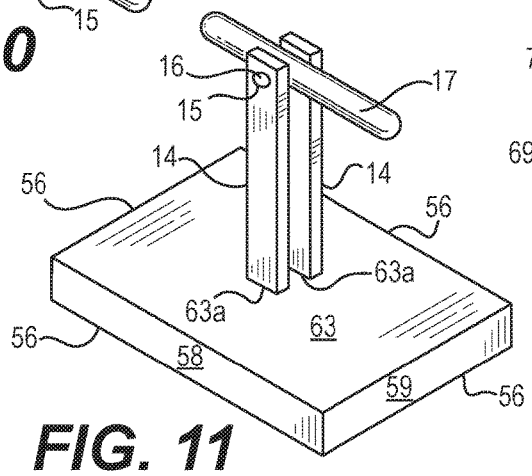
FIG. 11 illustrates a bottom perspective view of the stainless steel cufflink member according to FIG. 10 and FIG. 10A of the present invention.

In FIGS. 10 and 11, the stainless steel frame housing 56 has a conventional shank fastening assembly affixed to a bottom surface 63. The shank fastening assembly includes a pair of longitudinal extending and spaced apart leg members 14 with securing ends 63*a* secured directly to the bottom surface 63 by a mechanical securing method selected from the group consisting of welding, soldering, adhesives, glues and other types of bonding materials. The shank fastening assembly further includes a toggle pin hole 15 disposed at an aligned lower end of the pair of longitudinal extending and spaced apart leg members 14 for receiving a toggle pin 16 there through to secure a toggle bar 17 at the aligned lower end to enable the toggle bar 17 to be fastened to one side of a shirt cuff by inserting it through a shirt or blouse cuff opening. Since this a conventional cufflink shank fastening assembly there will be no further discussion as to its operation and components, which has been previously described in the aforementioned FIGS. 1-9.

Also, the shank fastening assembly is made from the preferred material such as stainless steel. Optionally, other materials can be utilized, such as materials selected from the aforementioned group consisting of wood, gold, brass, aluminum, silver and any combination thereof. Note that other types of metals and/or plastics could be utilized, if desired.

Figure 10A:
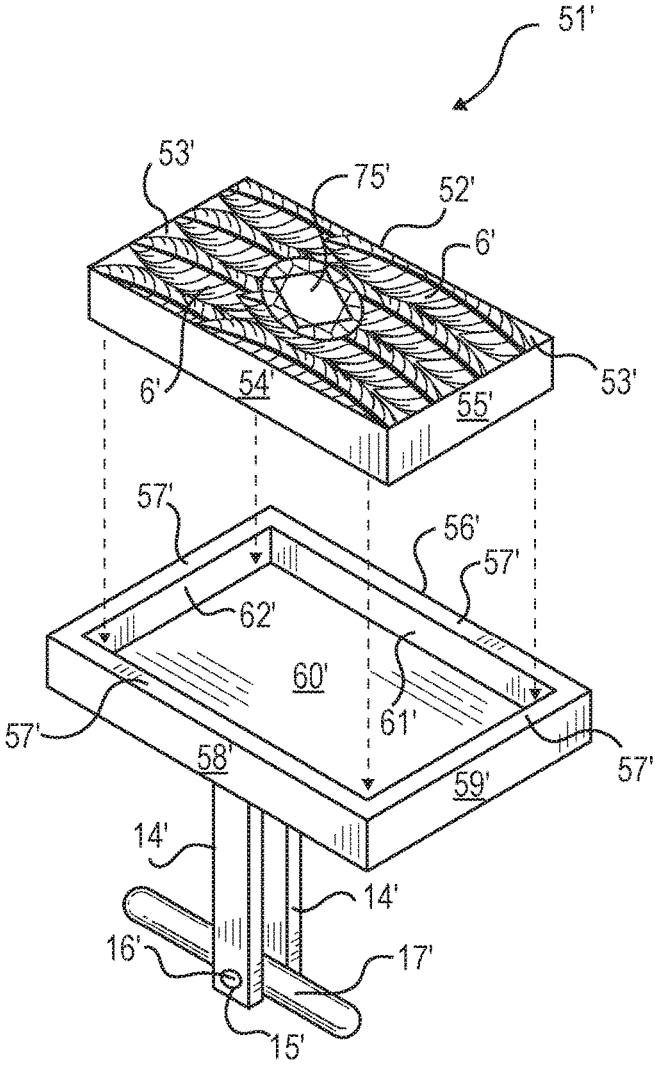
FIG. 10A an exploded top perspective view of a jewelry piece or ornament defining a stainless steel cufflink member having a cavity for receiving an exotic and authentic or natural wood member with exotic and authentic or natural feathers and at least a jewelry stone disposed thereon and without a protective shield member according to FIG. 10 of the present invention.

The cufflink assembly as shown in FIG. 10A is represented by reference numeral 51'. Note that the cufflink assembly 51' is the same as the cufflink assembly E as illustrated in FIG. 10 except for having a shield or cover member 51 as shown in FIG. 10, which is placed over the exotic and authentic or natural feather arrangement 6 to provide protection for the exotic and authentic or natural feather arrangement 6. Therefore, in order to obviate any redundancy the same reference numerals in FIG. 10 are the same and labeled with a prime symbol (') as shown in FIG. 10A. For an explanation of the reference numerals as shown in FIG. 10A, see the above recited explanations of the reference numerals for FIG. 10.

The omission of the shield or cover 51 in 10A allows for the exotic and authentic or natural feather arrangement 6' and the exotic and authentic or natural and polished wood member 52' to bring out the unique beauty and colors of the exotic and authentic or natural feather arrangement 6' and the wood-grain of the exotic and authentic or natural and polished wood member 52' for an unbelievable fashionable look. This uncovering allows the feather arrangement 6' to be disposed within holes, cavities, slots or channels of different shapes or configurations and sizes within the beautiful exotic and authentic or natural and polished wood member 52' of different sizes and shapes or configurations in such a manner that the feather arrangements 6' are protected and the beautiful colors of the feather arrangements 6' and the wood-grain of the beautiful exotic and authentic or natural and polished wood member 52' are visibly optimized and overcoming any light interference.

It is to be noted that any one of the covers or shield members 1, 20, 24, 35, 51, 64, 76, 92 and 93 illustrated in all of the FIGS. 1-18 can be omitted, if desired, for the same reasons recited above.

Figure 12:
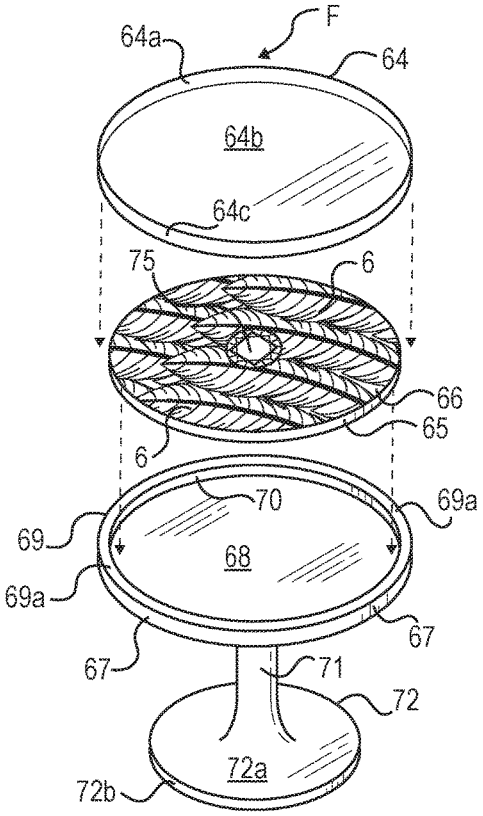
FIG. 12 illustrates an exploded top perspective view of a jewelry piece defining a clothing stud member having a cavity for receiving an exotic and authentic or natural wood member with exotic and authentic or natural feathers and at least a jewelry stone disposed thereon and being covered with a protective shield member according to the present invention.

FIG. 12 illustrates an exploded top perspective view of a jewelry piece or ornament defining a clothing stud assembly represented by reference letter F useable with clothing button holes and cuff openings of shirts, blouses, jackets, coats, sweaters, etc. The clothing stud assembly F includes a cover or shield member 64 with an inner peripheral wall rim portion 64*a*, an outer peripheral wall rim portion 64*c* and an inner surface 64*b* bounded by the inner peripheral wall rim portion 64*a* and the outer peripheral wall rim portion 64*c*.

The clothing stud assembly F further includes an exotic and authentic or natural and polished wood member 65 with a top surface 66 that has an exotic and authentic or natural feather arrangement 6 affixed thereto by one of the aforementioned bonding materials. A jewelry stone or gem 75 is secured to the top surface 66 by the previously mentioned bonding materials or by various other types of mechanical fastening means bounded by the exotic and authentic or natural feather arrangement 6.

In addition, the clothing stud assembly F includes a clothing stud frame member 69 defining a top portion having a cavity receiving portion 68 with an inner peripheral wall rim portion 70, an outer peripheral wall rim portion 67 and a top peripheral wall rim portion 69*a* that provides the peripheral boundary therefore. Also, an integral shank fastening assembly 71 affixed to a bottom surface 73 of the cavity receiving portion 68 by an upper end. Note that the shank assembly 71 can be a separate member that is secured to the bottom surface 73 by the aforementioned bonding materials or by various other types of mechanical securing means, if desired. The other end of the shank assembly 71 includes a bottom support plate member 72 that has a top support plate surface 72*a*, an outer peripheral wall portion 72*b* and a bottom support plate surface 74 (see FIG. 13).

In creating a complete clothing stud assembly F, first the exotic and authentic or natural and polished wood member 65 is placed within the cavity receiving portion 68 of the clothing stud frame 69 and bonded therein. Then the cover or shield member 64 is placed and secured over the exotic and authentic or natural feather arrangement 6 and about the outer peripheral wall rim portion 67 and resting on the top peripheral wall rim portion 69*a*. The securing means for the cover or shield member 64 is selected from the aforementioned bonding material or by various other types of mechanical securing means, if desired.

Figure 13:
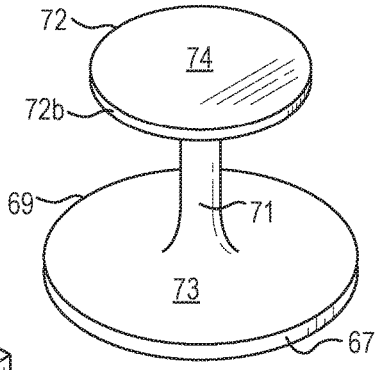
FIG. 13 illustrates a bottom perspective view of the clothing stud member according to FIG. 12 of the present invention.

FIG. 13 depicts an upside down view of the complete clothing stud assembly F that shows the clothing stud frame member 69, the top peripheral wall rim portion 69*a*, the shank member 71, the bottom surface 73 and the outer peripheral wall rim portion 67 of the cavity receiving portion 68 and the bottom support plate surface 74 of the bottom support plate member 72 surrounded by the outer peripheral wall portion 72*b* as discussed in FIG. 12 above.

Figure 14:
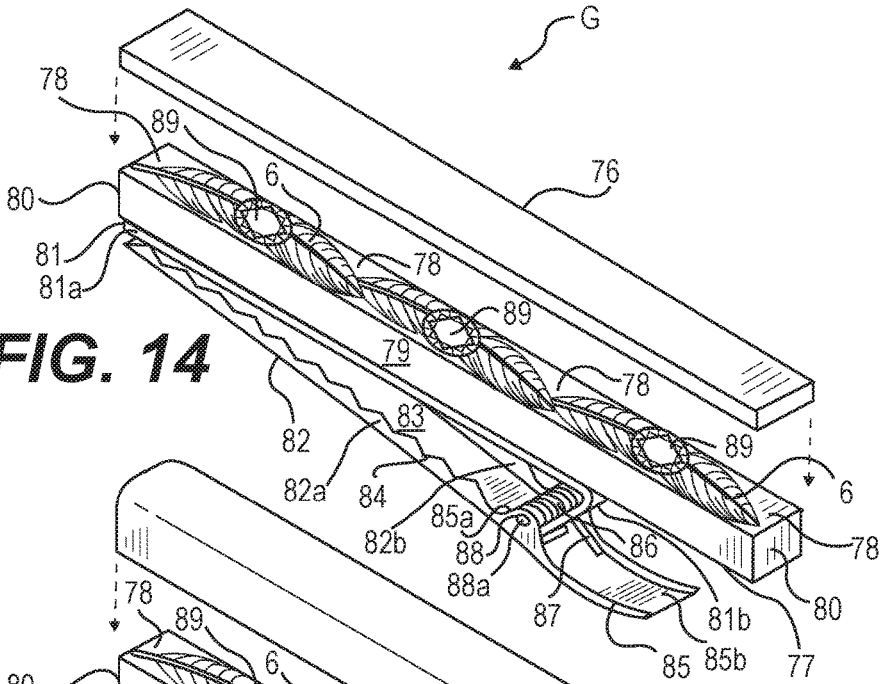
FIG. 14 illustrates an exploded perspective view of a jewelry piece defining a tie bar or tie clip having a top surface for receiving an exotic and authentic or natural wood member with exotic and authentic or natural feathers and at least a jewelry stone attached thereon and having a protective shield member for covering a top portion of the exotic and authentic or natural wood member and the exotic and authentic or natural feathers and the at least a jewelry stone according to the present invention.

The embodiment as illustrated in FIG. 14 is represented by reference letter G of a jewelry piece defined as tie bar or clip assembly. The tie bar or clip assembly G includes a transparent cover or shield member 76, an exotic and authentic or natural and polished wood member 77 with a top surface 78, a bottom surface 78*a* (see FIG. 16), opposite front and rear end portions 80, elongated side wall portions 79, a tie bar or clip frame member 81 having a pair of side wall portions 81*a*, a top support surface 81*b*, the top support surface having a downward extending bent portion 81*c* (will be discussed in greater detail later), an actuating shank fastening assembly 82 including a top surface 83, a pair of opposite side wall portions 82*a*, a pair of serrated portions 84 extending along a top end of the pair of opposite side wall portions 82*a*, an actuating handle member 85 being disposed at the rearmost end of the actuating shank fastening assembly 82, a spring member 86 with a biasing arm 87 that engages a top surface portion 85*b* of the actuating handle member 85 and a spring securing pin 88*a* inserted through an opening 88 in an upstanding portion 85*a* disposed on opposite sides of the actuating handle member 85 at a front portion thereof for holding the spring member 86 in a fixed position, while allowing the actuating handle member 85 to be pivoted thereabout.

Further the bent portion 81*c* provides a support seat for the spring member 86. The upstanding portion 85*a* is integrally connected between a rear end of the opposite side wall portions 82*a* of the support base member 82, the rear end of the serrated portions 84 and the front portion of the actuating handle member 85.

An exotic and authentic or natural feather arrangement is disposed along the top surface 78 of the exotic and authentic or natural and polished wood member 77 and secured thereto by the aforementioned bonding material or the various other types of mechanical securing means. The top surface 78 of the exotic and authentic or natural and polished wood member 77 includes a plurality of jewelry stones or gems 89 bonded thereto with the feather arrangement 6 disposed thereabout to create a beautiful and colorful ornamental design. Then the transparent cover or shield 76 is affixed over the exotic and authentic or natural feather arrangement 6 and the plurality of jewelry stones or gems 89 to protect the feather arrangement 6 and the plurality of jewelry stones or gems 89 from damage and allow the beautiful colors of the feather arrangement 6 and the plurality of jewelry stones 89 to be clearly shown via the transparent cover or shield member 76 in a very unique and fashionable manner.

In operation, when a user actuate the actuating handle member 85, it will compress the spring arm 87 against the top surface 85*b* of the actuating handle member 85 and pivot the pair of serrated portions 84 of the pair of opposite side wall portions 82*a* away from the bottom surface 90 (see FIG. 16) of the tie bar or clip frame member 81 to allow a neck tie member to be inserted or removed from there between. No additional explanation is needed, since this operation is conventional for tie bar or clip assemblies.

Figure 15:
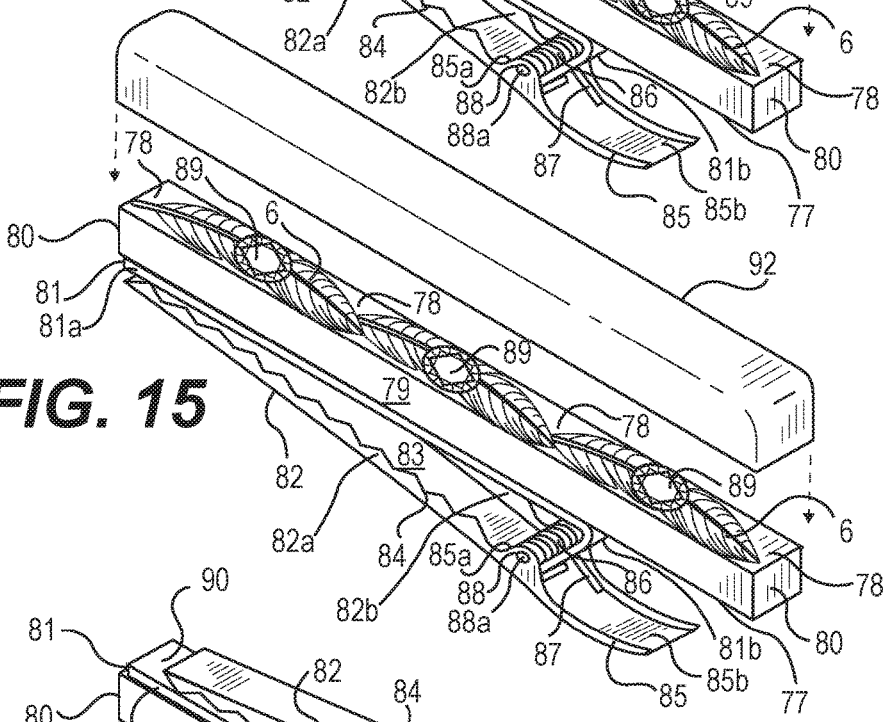
FIG. 15 illustrates an exploded perspective view of a jewelry piece defining a tie bar or tie clip having a top surface for receiving an exotic and authentic or natural wood member with exotic and authentic or natural feathers and at least a jewelry stone attached thereto and having a protective shield member that covers a top surface portion and side wall portions of the exotic and authentic or natural wood member with the exotic and authentic or natural feathers and the at least a jewelry stone according to the present invention.

The tie bar or clip illustrated in FIG. 15 is the same as shown in FIG. 14 with the same reference numerals except for the different type of transparent cover or shield member 92. The difference between the transparent cover or shield member 76 and the transparent cover or shield member 92 will now be discussed.

As shown in FIG. 15, the transparent cover or shield member 92 covers the entire exotic and authentic or natural and polished wood member 77, across the top surface 78, the opposite front and rear end portions 80 and the elongated side wall portions 79. This allows the feather arrangement 6, the plurality of jewelry stones 89 and the exotic and authentic or natural and polished wood member 77 to be completely protected from any damage.

Figure 16:
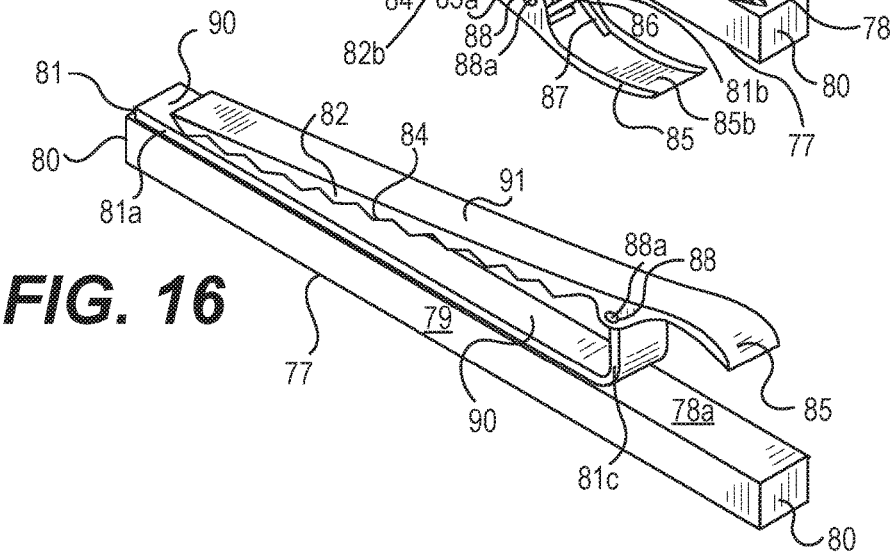
FIG. 16 illustrates a bottom perspective view of the tie bar or tie clip according to FIG. 14 and FIG. 15 of the present invention.

Now referring to FIG. 16, which is an upside down view of FIGS. 14-15 with some of the same references except for those that are not shown in FIGS. 14-15. Therefore, only the references not shown in FIGS. 14-15 will be discussed to eliminate any redundancy.

The aforementioned bent portion 81*c*, the bottom surface 90 of the tie bar or clip frame member 82 with the actuating handle member 85 and a bottom surface 78*a* of the exotic and authentic or natural and polished wood member 77 are the reference numerals shown in FIG. 16 and not in FIGS. 14-15.

Figure 17:
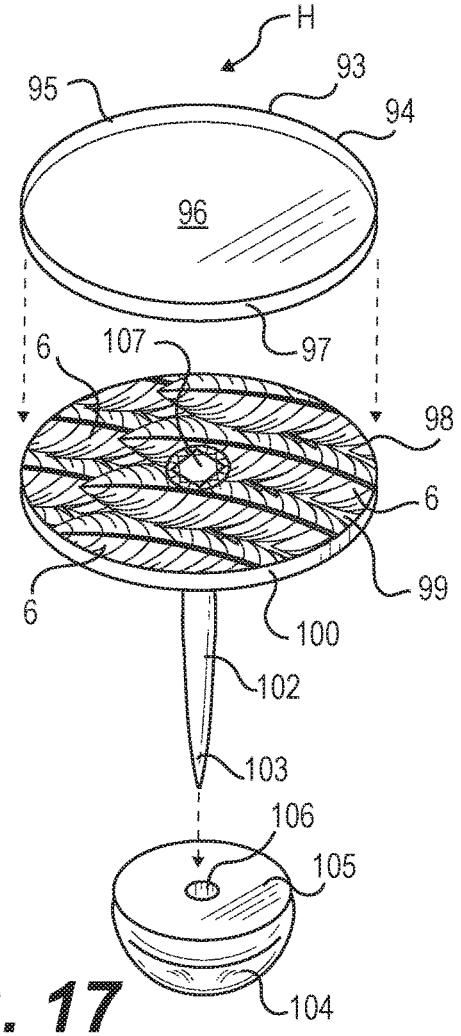
FIG. 17 illustrates an exploded perspective view of a jewelry piece defining a tie pin having a top surface for receiving an exotic and authentic or natural wood member with exotic and authentic or natural feathers and at least a jewelry stone attached thereon and having a protective shield member for covering the entire exotic and authentic or natural wood member with the exotic and authentic or natural feathers and the at least a jewelry stone according to the present invention.

Now referring to FIG. 17, this embodiment shows a jewelry piece that defines an ornamental clothing pin assembly H, such as a tie pin, brooch, pin, etc. The ornamental clothing pin assembly H includes an exotic and authentic or natural and polished wood member 98 having a top surface 99, an outer circumferential wall rim portion 100, a feather arrangement 6 with at least one jewelry stone or gem 107 secured to the a top surface 99, a transparent cover or shield member 93, a shank fastening pin assembly 102 having a pointed or tapered tip end 103 and a friction clutch fastener 104 having a top surface 105 and a friction clutch opening 106.

The transparent cover or shield member 93 includes a top surface 94 and an inner lower or bottom surface 96 that is bounded by an outer circumferential wall rim portion 95 and an inner circumferential wall rim portion 97.

In a protective condition, the transparent cover or shield member 93 is placed completely over and about the exotic and authentic or natural and polished wood member 98. This allows the inner surface 96 to completely cover the feather arrangement 6 and the at least one jewelry stone or gem 107 and the inner circumferential wall rim portion 97 will engage about and completely cover the outer circumferential wall rim portion 100 of the exotic and authentic or natural and polished wood member 98 to prevent any damage thereto.

Figure 18:
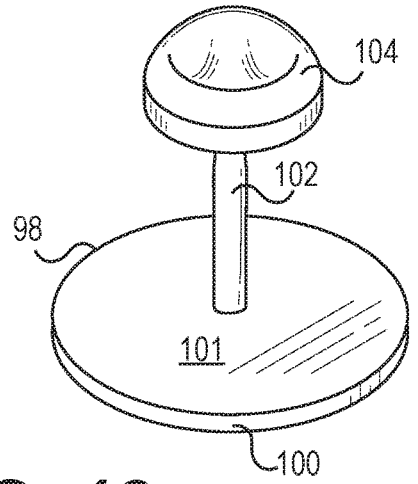
FIG. 18 illustrates a bottom perspective view of the tie pin according to FIG. 17 of the present invention.

Now in accordance to FIG. 18, it shows an upside down view of the clothing pin assembly H. This embodiment has the same reference numerals as shown and described in FIG. 17. Therefore, these reference numerals will not be discussed to overcome redundancy of the above discussed description as explained for FIG. 17. However, the only reference numeral not discussed above for FIG. 17 is the bottom surface 101 of the exotic and authentic or natural and polished wood member 98. Also, FIG. 18 shows the friction clutch fastener 104 being engaged with the pin pointed tip end 103 into the friction clutch opening 106 of the shank fastener pin assembly 102. This allows the clothing pin assembly H to be fastened to a clothing piece for holding a tie in place or utilized as a brooch, clothing or a hat decorative ornamental pin, etc.

Please note that decorative ornamental tie pins, brooches, clothing pins or hat pins are well known in the art, but none of the aforementioned and disclosed prior art teaches the unique exotic and authentic or natural and polished wood members and the exotic and authentic or natural feather arrangements 6 and 6' as described in FIGS. 1-18. Note that the feather arrangements 6 and 6' can be of different types of feathers, a single feather or a plurality of colorful feathers, if desired.

Furthermore, it is to be clearly understood that the feather arrangements 6 or 6' as shown in FIGS. 1-18 could be replaced or utilized in combination with other types of arrangements selected from and not limited to the group consisting of colorful shells, butterfly wings, leaves, flowers, fossils, antlers, horns, bones and teeth to name just a few.

According to the present invention all of the jewelry stones or gems as shown in FIGS. 1-18 may be selected from and not limited to the aforementioned selected group consisting of different sizes, shapes and types of precious and semi-precious stones or gems, such as crystals, diamonds, emeralds, fossil coral, garnet, gems, jasper, jadeite, pearls, opal, quartz, rubies, sapphire, Tiger's eye, topaz, tourmaline and many other types of jewelry stones or gems.

While the foregoing written description of the invention enables one of ordinary skill in the art to make and use what is considered presently to be the best mode thereof, those of ordinary skill will understand and appreciate the existence of variations, combinations, and equivalents of the specific embodiment, method, and examples herein. The invention should therefore not be limited by the above described embodiments, and examples, but by all embodiments and methods within the scope and spirit of the invention as claimed.

What is claimed is:

1. An improved jewelry piece assembly comprising:

a transparent cover member;

a first natural and polished wood member, the first natural and polished wood member having a top portion and an outer peripheral wall portion extending there from;

an at least one natural feather arrangement is disposed and secured to the top portion and extending across at least a major portion of the top portion of the first natural and polished wood member defining a single unit;

a second natural and polished wood member defining a frame housing member, the frame housing member including a cavity formed therein, the frame housing member having a top surface portion, the cavity is bounded by an outer peripheral side wall portion, and the first natural and polished wood member and the at least one natural feather arrangement single unit are disposed within the cavity;

a fastening assembly is cooperatively associated with the second natural and polished wood member; and the transparent cover member is placed at least over the first natural and polished wood member and the at least one natural feather arrangement single unit to protect the natural feather arrangement from any damage.

2. The improved jewelry piece assembly according to claim 1, wherein the at least one natural feather arrangement may be replaced or utilized in combination with various arrangements selected from and not limited to the group consisting colorful sea shells, butterfly wings, leaves, flowers, fossils, antlers, horns, bones and teeth.

3. The improved jewelry piece assembly according to claim 1, wherein the outer side wall portion of the frame housing member includes front and rear end wall portions at an upper end thereof, a pair of side wall portions at an upper end thereof, an upper top wall rim edge portion integrally formed at the top of the upper front and rear end wall portions and the pair of upper side wall portions, lower front and rear end wall portions and a pair of lower side wall portions that forms a continuous outer peripheral side wall and a bottom surface portion that supports and is connected thereto, the at least one natural feather arrangement is positioned within the cavity of the frame housing member defined by the top wall rim edge portion at the top of the front and rear end wall portions and the pair of side wall portions, an intermediate continuous groove is disposed entirely around and between the upper and lower front and rear end wall portions and the upper and lower pair of side wall portions, the intermediate continuous groove includes another natural feather arrangement member disposed and secured therein and the transparent cover member is placed over at least the first natural and polished wood member and the at least one natural feather arrangement single unit disposed within the cavity and the another feather arrangement that is disposed in the intermediate continuous groove of the continuous outer peripheral side wall of the frame housing member to prevent any damage to both natural feather arrangements of the first and second natural and polished wood members.

4. The improved jewelry piece assembly according to claim 3, wherein the single unit defined by the first natural and polished wood member and the at least one natural feather arrangement extends to a peripheral height that is at least equal to the depth of the cavity that is defined by the height extending between the front and rear end wall portions, the pair of side wall portions, the upper top wall rim edge portion and the bottom support floor surface of the second natural and polished wood member.

5. The improved jewelry piece assembly according to claim 3, wherein the transparent cover member is placed over the entire area of the first natural and polished wood member and the at least one feather arrangement single unit within the cavity, the second natural and polished wood member and the another feather arrangement positioned within the intermediate continuous and over at least a major portion of the continuous outer peripheral side wall of the frame housing member to prevent any damage thereto.

6. The improved jewelry piece assembly according to claim 1, wherein the cavity includes a bottom support floor surface that is connected to the outer side wall portion, which sets the boundary for the cavity.

7. The improved jewelry piece assembly according to claim 4, wherein the first natural and polished wood member is secured within the cavity and rests on the bottom support floor surface, the cavity having a depth that extends between the support floor member and the upper top wall rim edge portion of the frame housing member, wherein the first natural and polished wood member having a height that is at least equal to the depth of the cavity.

8. The improved jewelry piece assembly according to claim 1, wherein the second natural and polished wood member that forms the frame housing member, which defines a U-shaped housing that is bounded by the outer side wall portion, the outer side wall portion includes a pair of front and rear end wall portions defining open ends, a pair of side wall portions and an upper top wall rim edge portion at the top of the front and rear end wall portions and the pair of side wall portions, the upper top wall rim edge portion is integrally formed at the top of the front and rear end wall portion open ends and the pair of side wall portions and the pair of side wall portions that include a slot therein.

9. The improved jewelry piece assembly according to claim 8, wherein at least another feather arrangement is disposed and secured within the slot of the pair of side wall portions, the cavity is formed within the U-shaped housing and connected to a bottom support floor surface that is bounded by the front and rear end wall portion open ends, the pair of side wall portions and the upper top wall rim edge portion, the second natural and polished wood member includes the first natural and polished wood member that is secured within the cavity portion by a bonding material and resting on the bottom support floor surface, the first natural and polished wood member and the at least one feather arrangement are disposed within the cavity and extending from the bottom support floor surface and upward and along the front and rear end wall portions open ends, the pair of side wall portions and up to the upper top wall rim edge portion to allow the transparent cover member to be placed at least over the first natural and polished wood member and the at least one natural feather arrangement single unit for protection against any damage thereto.

10. The improved jewelry piece assembly according to claim 9, wherein the transparent cover member is placed over the entire area of the first natural and polished wood member single unit, over at least a portion of the U-shaped housing and completely over the another natural feather arrangement disposed in the slot of the pair of side wall portions for covering both of the natural feather arrangement members to prevent any damage thereto.

11. The improved jewelry piece assembly according to claim 1, wherein the second natural and polished wood member defines a U-shaped open front end housing defined by a pair of L-shaped front wall end members, a rear wall member defining a closed rear end, a pair of inner and outer side wall members connected to the rear wall member with an upper U-shaped top wall rim edge portion, the rear wall member and the pair of side wall members are bounded and connected by a bottom floor member at a lower end of the pair of L-shaped front wall end members that forms a U-shaped cavity therein and the pair of inner side wall members include an elongated channel disposed there along with at least a hardened type material positioned therein.

12. The improved jewelry piece assembly according to claim 11, wherein the bottom floor member includes a top surface portion and a bottom surface portion, the bottom surface portion includes a pair of spaced apart open-ended slots that extend across a portion thereof, the pair of spaced apart open-ended slots are disposed between the pair of L-shaped front wall end members and the rear wall member closed rear end near the interconnection of the bottom surface portion and a lower end of the inner and outer side wall members and the pair of spaced apart open-ended slots extend upward and into a co-operating relationship with the elongated channels within the inner side wall members for inserting the at least a hardened type material through the spaced apart open-ended slots and up into each of the elongated channels.

13. The improved jewelry piece assembly according to claim 12, wherein the hardened type material includes an aperture positioned in a central location in a bottom surface thereof, the aperture allows a tool member to be inserted therein to easily insert and remove the hardened type material into and out of the spaced apart slots and the elongated channels, wherein the at least a hardened type material is secured within the spaced apart slots and the elongated channels by a tight friction fit.

14. The improved jewelry piece assembly according to claim 13, wherein the first natural and polished wood member further includes a reversible sliding tray-like member is made of another hardened type material, the reversible sliding tray-like member includes a front and rear end wall edge surfaces and a pair of side wall edge surfaces, top and bottom flat surfaces, an elongated handle member and the elongated handle member having front and rear end surfaces, a top surface and a bottom surface.

15. The improved jewelry piece assembly according to claim 14, wherein the front end surface of the handle member being secured to the front end wall edge surface of the reversible sliding tray-like member to form a unitary member to allow a user to easily grasp and slide the reversible sliding tray-like member along the elongated channels.

16. The improved jewelry piece assembly according to claim 15, wherein at least another pair of natural and polished wood members being secured to the top and bottom flat surfaces of the reversible sliding tray-like member with a separate and distinct natural feather arrangement secured to the top and bottom flat surfaces of the reversible top reversible sliding tray-like member, wherein the pair of side wall edge surfaces of the reversible sliding tray-like member is able to slide along the elongated channels of the inner side wall members by a user grasping the handle and moving the reversible top reversible sliding tray-like member until the rear end surface of the handle member engages the L-shaped front wall end members and the rear end wall edge surface of the reversible sliding tray-like member engages the rear wall member closed rear end in a fully inserted position to close the U-shaped open front end housing to display the beauty of the separate and distinct natural feather arrangement on the top flat surface, then a user grasps the handle member and slide the reversible sliding tray-like member along the elongated channels of the inner side wall members until it has been removed and reversed and slid back into a fully inserted position to display the beauty of the other separate and distinct natural feather arrangement.

17. The improved jewelry piece assembly according to claim 16, wherein the at least another pair of natural and polished wood members with the separate and distinct natural feather arrangements secured to the top and bottom flat surfaces of the reversible top reversible sliding tray-like member includes a transparent cover member disposed entirely over the separate and distinct natural feather arrangements and secured to the top and bottom flat surfaces of the reversible sliding tray-like member and inward of the front and rear end wall edge surfaces and the pair of side wall edge surfaces of the reversible sliding tray-like member to avoid any interference with the sliding of the reversible sliding tray-like member within and along the elongated channels in the pair of inner side wall members and the transparent cover member provides protection against any damage and maintains the beauty of the natural feather arrangements.

18. The improved jewelry piece assembly according to claim 17, wherein the first and second natural and polished wood members and the at least another pair of natural and polished wood members can be beautifully finished with water-based or oil-based finishes selected at least from the group consisting of different types of water-based or oil-based resins, glues, epoxy, varnishes, stains, dyes, lacquers, shellac, glazing and toning, pickling and liming, bleaching, distressing, enamels, polyurethane, natural oils and waxes, preservers, paints (glossy or semi-glossy) and any combinations thereof.

19. The improved jewelry piece assembly according to claim 18, wherein the first and second and the at least another pair of natural and polished wood members can be made from other materials and selected at least from the group consisting of stainless steel, gold, brass, aluminum, silver and any combination thereof.

20. The improved jewelry piece assembly according to claim 14, wherein the hardened-like material is selected from the group of wear resistance type materials consisting of Formica, hard plastics, coatings and ceramics.

21. The improved jewelry piece assembly according to claim 1, wherein the first and second natural and polished wood members can be made from other materials and selected at least from the group consisting of stainless steel, gold, brass, aluminum, silver and any combination thereof.

22. The improved jewelry piece assembly according to claim 1, wherein the cover member can be made and selected at least from a transparent material and selected at least from the group consisting of resins, glass and plastics.

23. An improved jewelry ornament comprising:

a transparent shield member;

a first authentic and finished wood member, the first authentic and finished wood member having a top surface portion, a pair of side wall portions and front and rear side wall end portions defining an outer peripheral wall;

a second authentic and finished wood member defining a frame member, the frame member includes a top surface portion with a cavity formed therein, at least a side wall portion defining an outer wall portion that surrounds at least a portion of the cavity and a bottom surface portion defining a floor member for the cavity and is connected to a lower end of the outer wall portion;

a shank fastening assembly being cooperatively fixed to the bottom surface portion of the frame member;

the first authentic and finished wood member having at least an authentic feather arrangement that is disposed and secured to a major portion of the top surface portion of the first authentic and finished wood member and the first authentic and finished wood member and the at least an authentic feather arrangement is positioned and secured within the cavity of the second authentic and finished wood and the transparent shield member is disposed over at least the first authentic and finished wood member and the at least an authentic feather arrangement to completely cover the at least a feather arrangement and the first authentic and finished wood member to protect them from any damage while being enclosed within the cavity.

24. The improved jewelry ornament according to claim 23, wherein the first authentic and finished wood member and the at least an authentic feather arrangement are secured by a selective bonding material, the outer wall portion of the frame member includes a groove member formed in at least a portion of the outer wall portion of the frame member, an another authentic feather arrangement is positioned and secured within the groove member by the selective bonding material, the transparent shield member being secured by the selective bonding material about the outer wall portion of the frame housing to completely cover the first authentic and finished wood member and the at least an authentic feather arrangement and at least a portion of the outer wall portion of the frame member and the another feather arrangement that is disposed within the groove member to protect them from any damage and at the same time displaying and maintaining the beauty of both feather arrangements and the first and the at least a portion of the second authentic and finished wood members.

25. The improved jewelry ornament according to claim 23, wherein the at least an authentic feather arrangement includes a plurality of feathers and at least one jewelry stone embedded and surrounded therein and secured by the selective bonding material to the top surface of the first authentic and finished wood member, the jewelry stone being selected at least from the group consisting of different sizes, shapes and types of precious and semi-precious stones or gems, such as crystals, diamonds, emeralds, fossil coral, garnet, gems, jasper, jadeite, pearls, opal, quartz, rubies, sapphire, Tiger's eye, topaz, tourmaline and many other types of jewelry stones or gems.

26. The improved jewelry member according to claim 23, wherein the shank fastening assembly includes a shank fastening member that is secured by the selective bonding material to the bottom surface of the frame member, the shank fastening member includes a pair of longitudinal extending and spaced apart leg members having an upper end portion that is secured to the bottom surface of the second authentic and finished wood member, a toggle bar, a toggle pin, a toggle pin hole at an aligned lower end portion of each of the pair of longitudinal extending and spaced apart leg members, the toggle bar is disposed between the pair of longitudinal extending and spaced apart leg members and the aligned toggle pin holes by inserting the toggle pin through the aligned pin holes for pivotally securing the toggle bar there between, and the toggle bar is adapted to be fastened to one side of a clothing item by inserting it through at least a clothing opening.

27. The improved jewelry ornament according to claim 23, wherein the shank fastening assembly includes an elongated member with a top end integrally connected to the bottom surface of the frame member of the second authentic and finished wood member and a lower end having a foot plate member, which defines a clothing stud that is adapted to be fastened to a clothing item by inserting it through clothing openings disposed thereon.

28. The improved jewelry ornament according to 23, wherein the shank fastening assembly and the first and second authentic and finished wood members are at least selected from and not limited to the group consisting of wood, stainless steel, gold, brass, aluminum, silver, bronze, other types of metals and any combinations thereof.

29. The improved jewelry ornament according to claim 23, wherein the at least an authentic feather arrangement is secured to the major portion of the top surface portion of the first authentic and finished wood member and the first authentic and finished wood member and the at least an authentic feather arrangement is secured within the cavity of the second authentic and finished wood and the transparent shield member is secured over at least the first authentic and finished wood member and the at least an authentic feather arrangement and over at least a portion of the second authentic and finished wood member by a bonding material selected at least from and not limited to the group consisting of welding, soldering, resins, adhesives, glues, cements and other types of bonding materials.

30. The improved jewelry ornament according to claim 23, wherein the improved jewelry ornament can be of different sizes and shapes and at least selected from and not limited to the group consisting of cuff links, tie bars or clips, tie pins, bolo ties, fastening studs, brooches, bracelets, armlets, chokers, bangles, finger and ear rings, scarf pins, barrettes, hair pins, hair hanglets, hat pins, necklaces, sarpech, breastplates, belly chains, findings, emblems, lockets, medallions, pendants, prayer jewelry, pledge pins, cameo, body piercing jewelry, costume jewelry, chatelaines, fascinators, head bands and membership pins and other types of jewelry pieces.

* * * * *